US010286651B2

(12) United States Patent
Stefani et al.

(10) Patent No.: US 10,286,651 B2
(45) Date of Patent: May 14, 2019

(54) CONTROL METHOD FOR DETECTING THE OPERATING STATUS OF THE NOZZLES OF AN INK-JET PRINTHEAD

(71) Applicant: SYSTEM S.P.A., Fiorano Modenese (Modena) (IT)

(72) Inventors: Franco Stefani, Sassuolo (IT); Mohamed Ouassif, Varana Serramazzoni (IT)

(73) Assignee: SYSTEM S.P.A., Fiorano Modenese (IT)

( * ) Notice: Subject to any disclaimer, the term of this patent is extended or adjusted under 35 U.S.C. 154(b) by 0 days.

(21) Appl. No.: 15/736,025

(22) PCT Filed: Jul. 20, 2016

(86) PCT No.: PCT/IB2016/054302

§ 371 (c)(1),
(2) Date: Dec. 13, 2017

(87) PCT Pub. No.: WO2017/025830

PCT Pub. Date: Feb. 16, 2017

(65) Prior Publication Data

US 2018/0170033 A1 Jun. 21, 2018

(30) Foreign Application Priority Data

Aug. 7, 2015 (IT) ..... 102015000043366

(51) Int. Cl.

| | |
|---|---|
| ***B41J 2/14*** | (2006.01) |
| ***B41J 2/045*** | (2006.01) |
| ***B41J 2/165*** | (2006.01) |

(52) U.S. Cl.

CPC ..... *B41J 2/0451* (2013.01); *B41J 2/14* (2013.01); *B41J 2/16579* (2013.01); *B41J 2202/05* (2013.01); *B41J 2202/12* (2013.01)

(58) Field of Classification Search

CPC ..... B41J 2/0451; B41J 2/2139; B41J 2/2142; B41J 2/16579; B41J 2002/165

See application file for complete search history.

(56) References Cited

U.S. PATENT DOCUMENTS

| | | | |
|---|---|---|---|
| 5,980,034 | A | 11/1999 | Tsai et al. |
| 6,595,630 | B2 | 7/2003 | Jagannathan et al. |
| 8,567,895 | B2 | 10/2013 | Furukawa et al. |
| 9,399,353 | B2 | 7/2016 | Komatsu et al. |

(Continued)

FOREIGN PATENT DOCUMENTS

| | | | |
|---|---|---|---|
| EP | 1275511 | A2 | 1/2003 |
| EP | 2361771 | A2 | 8/2011 |

(Continued)

*Primary Examiner* — Julian D Huffman
(74) *Attorney, Agent, or Firm* — Pearne & Gordon LLP

(57) ABSTRACT

A control method for detecting the operating status of the nozzles of an ink-jet printhead, comprising the following steps: detecting an inlet pressure and an outlet pressure in a feeding channel (5) of the nozzles (6) in a closing condition of all the nozzles (6); detecting a reference pressure differential between the inlet pressure and the outlet pressure; opening each nozzle (6) in sequence and separately from the others; detecting the pressure differential between the inlet pressure and the outlet pressure in an opening condition of a single nozzle (6); comparing the detected differential pressure with the reference pressure differential.

10 Claims, 2 Drawing Sheets

(56) References Cited

U.S. PATENT DOCUMENTS

| | | | |
|---|---|---|---|
| 2003/0030706 | A1 | 2/2003 | Jagannathan et al. |
| 2007/0126779 | A1 | 6/2007 | Kyoso |
| 2011/0205265 | A1 | 8/2011 | Furukawa et al. |
| 2011/0227971 | A1 | 9/2011 | Hoshino |
| 2015/0085032 | A1 | 3/2015 | Ando et al. |
| 2015/0191021 | A1 | 7/2015 | Komatsu et al. |

FOREIGN PATENT DOCUMENTS

| | | | |
|---|---|---|---|
| EP | 2842753 | A1 | 3/2015 |
| EP | 2891557 | A1 | 7/2015 |
| WO | 9733754 | A1 | 9/1997 |

CONTROL METHOD FOR DETECTING THE OPERATING STATUS OF THE NOZZLES OF AN INK-JET PRINTHEAD

The invention has for an object a method for detecting the operating status of the nozzles of an ink-jet printer.

The method according to the present invention is particularly useful for detecting the presence of one or more occluded nozzles within an ink-jet printhead intended for the decoration of ceramic tiles.

The ink-jet printheads for the ceramic industry typically comprise an elongated support body internally of which a glaze feeding channel is disposed. A plurality of nozzles, each of which provided with a respective shutter, are opening onto the feeding channel. When the shutter is open, a certain amount of glaze may exit from the corresponding nozzle for being applied to the tile to be decorated.

In order faithfully and accurately to reproduce the provided decoration, it is required that all printhead nozzles are in perfect operating conditions. The presence of even only one occluded or partially occluded nozzle makes in fact appear an unwanted uniform line on the decorated surface.

Currently the presence of one or more occluded nozzles is detected with the prints generated by the printhead being tested, whether it deals of proof prints or prints made during processing. Given the size of the nozzles and the very small distances therebetween, the simple checking of the prints does not allow to clearly identify the obstructed nozzle or nozzles, for which reason it is required to basically check out all those nozzles suspected of being occluded and/or to replace the printhead thereof. In addition, performing test prints requires a great deal in terms of resources and time.

It is an object of the present invention is to provide a method for detecting the operating status of the nozzles of an ink-jet printer, as well as a printhead feeding circuit which allow to overcome the drawbacks of the techniques currently in use.

An advantage of the method according to the present invention is that it allows to exactly locate the nozzle or nozzles possibly occluded.

A further advantage of the method according to the present invention is that it does not require the execution of test prints.

Figure 1:
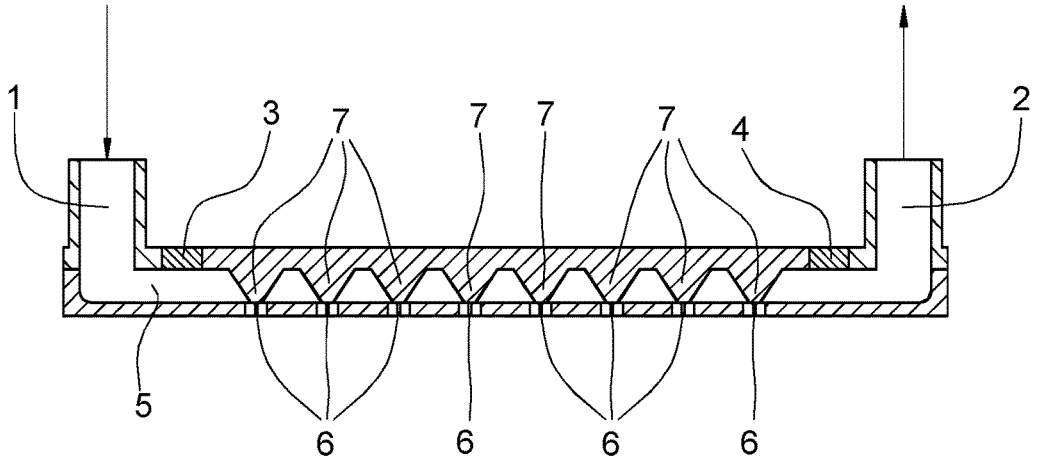
Figure 2:
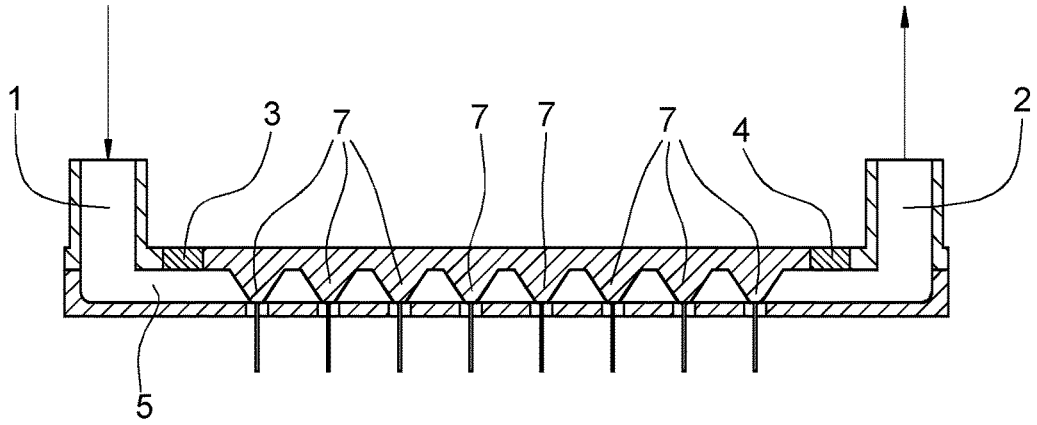
Figure 3:
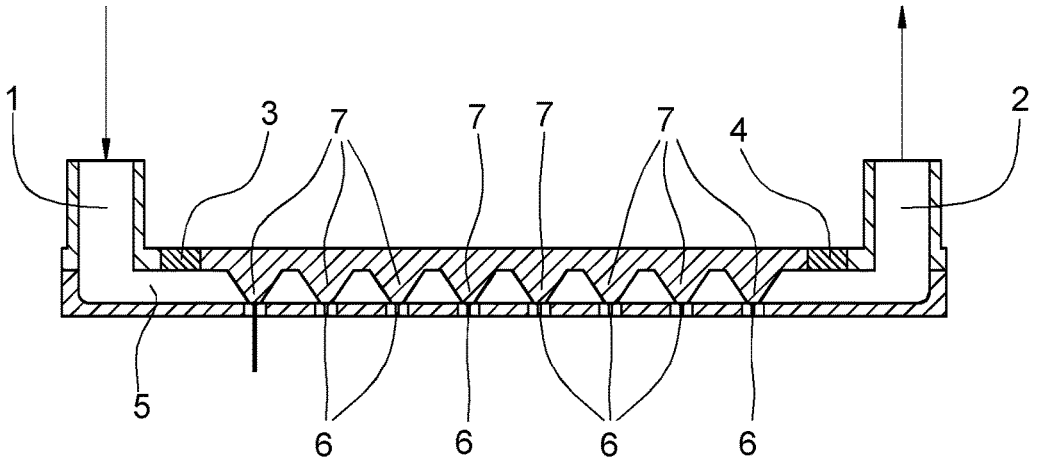
Figure 4:
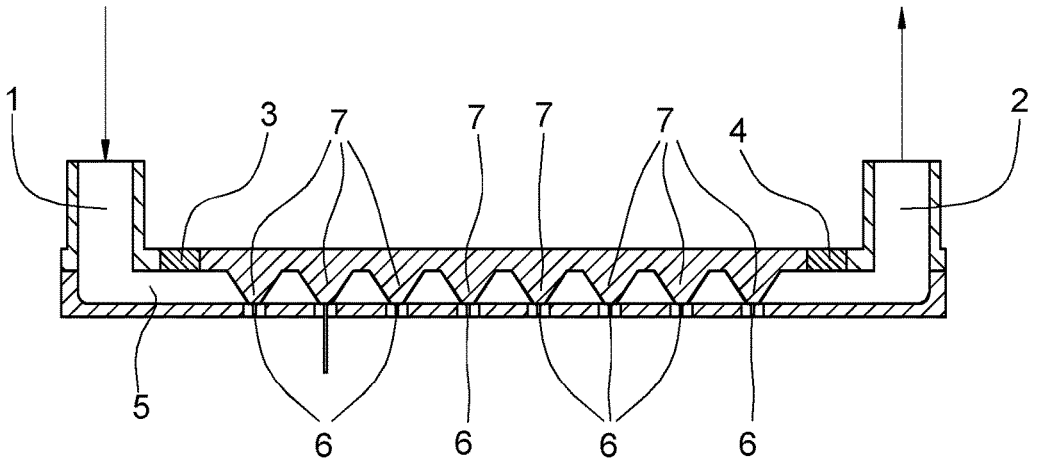

Further characteristics and advantages of the present invention will better emerge from the detailed description that follows of a preferred embodiment of the invention, illustrated by way of non-limiting example in the accompanying figures wherein:

FIG. 1 shows a schematic view of the feeding circuit according to the present invention and a printhead that incorporates the feeding circuit;

the FIGS. 2, 3 and 4 illustrate schematically some steps of the method according to the present invention.

With reference to the figures, the feeding circuit of an ink-jet printhead according to the present invention comprises a feeding channel (5), that is arranged for feeding a printing fluid to a plurality of nozzles (6), which is provided with an inlet section (1) and an outlet section (2). The figures depict the nozzles in the form of openings directly connected to the feeding channel (5). Other configurations are of course possible in which the nozzles (6) are connected to the feeding channel (5) in a different manner. The feeding channel (5) is in turn connected to a recirculation conduit not shown, in order that a closed circuit is formed along which the ink is constantly made to recirculate, or kept in motion, so as to prevent any sediments formation. The closed feeding circuit further comprises a tank and at least one pump. Even in the closed configuration of all the nozzles (6), the glaze is still made to recirculate along the feeding channel (5), the recirculation conduit and the tank.

Within the printhead, each nozzle (6) is provided with a corresponding shutter (7) controlled by a control unit between an open condition and a closed condition of the respective nozzle. Preferably, each shutter (7) is at least partially inserted into the feeding channel (5). In this way the nozzles (6) can be placed in direct communication with the feeding channel (5).

The circuit comprises a first pressure sensor (3), arranged so as to detect the pressure in the inlet section (1) of the channel (5), or in a zone proximate to the inlet section (1). The circuit further comprises a second pressure sensor (4), arranged so as to detect the pressure in the outlet section (2) of the channel (5), or in a zone close to the outlet section (2). The first and second pressure sensor (3,4) are connected to the control unit that controls opening and closing of the nozzles (6).

The pressure sensors (3,4) preferably measure the pressure of the fluid through the measurement of the deformation that the pressure exerted by the fluid produces on a deformable element. In particular, the pressure sensors (3,4) comprise a strain gauge.

The method according to the present invention for detecting the operating status of the nozzles comprises the steps set forth hereinafter.

At an initial stage, all the nozzles (6) are brought into a closed condition (FIG. 1). The inlet and outlet pressure is then detected in the feeding channel (5) of the nozzles (6) in a closing condition of all the nozzles (6). The detection is performed by the control unit via the pressure sensors (3,4) while the glaze is recirculating as usual. A first reference pressure differential (D1) between the inlet pressure and the outlet pressure is then detected and defined.

Subsequently each nozzle (6) is opened in sequence separately from the others (FIGS. 3 and 4) and, in the open condition of each individual nozzle (6) taken separately from the other nozzles (6), the pressure differential (Di) is detected between the inlet section and the outlet section. If each nozzle (6) is free and properly functioning, the opening of each nozzle is expected to cause a certain reduction of the pressure differential between the inlet section and the outlet section. In other words, the pressure differential detected (Di) must be lower than the first pressure differential (D1). Thus, if the pressure differential detected (Di) deviates beyond a certain value from the first reference pressure differential (D1), this means that the nozzle (6) is functioning correctly, and as such is identified by the control unit. If instead it is noted that the nozzle (6) opened individually does not cause a significant variation of the pressure differential (Di), or determines a variation of the differential below the preset deviation, then such a nozzle (6) is occluded or partially occluded.

The control unit then signals the presence of an occluded or non-functioning nozzle (6), also identifying which one is the occluded or non-functioning nozzle (6).

To increase the accuracy of the detection performed, it is possible to provide the measurement of a second reference pressure differential (D2), carried out upon first switching on of the printhead in a condition wherein the nozzles (6) are all open (FIG. 2). The second pressure differential can be used to determine the opening degree of each nozzle (6) and/or to determine the amount of fluid ejected by each nozzle.

More in detail, based on a feeding channel (5), a position coefficient (Cpi) for each nozzle (6) may be experimentally calculated that is expressed in decimal terms, which compensates the difference in the flow rate delivered by the various nozzles along the feeding channel (5). Essentially, the position coefficient is equal to one (Cpi=1) for those nozzles located in a central position, whilst for the nozzles located in the most extreme position, the position coefficient varies between about 0.95 and 1.05 (Cpi≈0.95÷1.05).

Once the position coefficient (Cpi) and the ideal working pressure (Pw) of the feeding circuit of the printing fluid are known, the loss of ideal pressure (Api) of each nozzle (6) is calculated as follows:

$$Api = \frac{Pw - D2}{\text{numero ugelli}} \times Cpi$$

(numero ugelli = number of nozzles)

Once the ideal pressure losses (Api) for each nozzle (6) are known, it is possible to proceed to the control cycle that provides to individually open the nozzles (6) in sequence. For each nozzle (6) it is then detected the pressure differential (Di) between the inlet section and the outlet section and the differential detected is compared with the loss of ideal pressure (Api) of the nozzle. If the differential detected (Di) deviates beyond a certain threshold with respect to the loss of ideal pressure (Api), then the control processor signals the nozzle as malfunctioning. The measure for the possible deviation between the detected differential (Di) and the loss of ideal pressure (Api) is further indicative of the difference between the flow rate of the fluid actually dispensed from the nozzle, and the ideal flow rate of the nozzle.

To limit the number of detections to be performed, that in so far described control cycle corresponds to the number of the present nozzles (6), the following alternative method may be implemented.

Instead of detecting the pressure differential (Di) between the inlet and the outlet for each nozzle (6) being opened separately from the others, it is possible to detect the pressure differential in relation to adjacent pairs of nozzles, that are open simultaneously but separately from the other nozzles.

Assuming to have a printhead provided with sixteen nozzles, wherein each nozzle is indicated with a progressive number (u1, u2, u3 . . . ) the two following set of nozzle pairs may be identifyed:

u1-u2; u3-u4; u5-u6; u7-u8; u9-u10; u11-u12; u13-u14; u15-u16; u2-u3; u4 u5-; u6-u7; u8-u9; u10-u11; u12-u13; u14-u15;

For each pair it is possible to calculate a loss of ideal pressure (Apc) in the following way:

$$Apc_{i,i+1} = \frac{Pw - D2}{\text{numero ugelli}} \times Cp_i + \frac{Pw - D2}{\text{numero ugelli}} \times Cp_{i+1}$$

(numero ugelli = number of nozzles)

or $$Apc_{i,i+1} = Ap_i + Ap_{i+1}$$

wherein, by "i" it is indicated the nozzle number.

Once the ideal pressure loss for each pair of adjacent nozzles becomes known, a control cycle ma be performed in which each pair of adjacent nozzles is brought in an open condition separately from the other pairs, and the pressure differential (Di, i+1) between the inlet section and outlet section of the feeding channel (5) is detected.

For each pair of nozzles the following conditions are possible:

a) the pressure differential detected (Di, i+1) is substantially equal to zero; this means that both nozzles are obstructed;

b) the pressure differential detected (Di, i+1) is substantially equal to the loss of ideal pressure ($Apc_{i,i+1}$) for the pair of adjacent nozzles; this means that both nozzles are correctly open;

c) the pressure differential detected (Di, i+1) is different from the ideal pressure loss ($Apc_{i,i+1}$) for the pair of adjacent nozzles; this means that at least one of the two nozzles of the pair is obstructed or partially obstructed, but it is not known which one.

Note that, apart from the first and sixteenth nozzle of the set, all the other nozzles are part of at least two pairs. The obstructed nozzles can be identified with certainty by comparing the conditions a, b, and c, of the two pairs to which each nozzle belongs. For example, consider the nozzles u7, u8, u9, u10 and assume that:

by the pair u7-u8 the a) condition applies;

by the pair u9-u10 the uncertainty condition c) applies;

by the pair u8-u9 the uncertainty condition c) applies.

Since the u8 nozzle is surely opened (given that the u7-u8-pair is in the a) condition, the uncertainty condition c) applied to the pair u8-u9 indicates with certainty that the nozzle u9 is occluded and, as consequence, the nozzle u10 must necessarily be opened.

To precisely define the operating status of all nozzles, it is therefore sufficient to run the control cycle for the first set of nozzle pairs and repeat the cycle for the second set of nozzle pairs that comprise a nozzle the functioning of which resulted uncertain. If need be, it is still possible to individually check the operating status of each nozzle as already described, thereby obtaining a certain information on the operating status thereof. However, for all those pairs having both nozzles occluded and/or malfunctioning, or open, one measure is sufficient instead of two that permits to obtain a reduction in time cycle.

In order to form nozzle pairs that are to be subjected to a process of checking, several combinations between the nozzles are obviously possible. It would be also possible to employ broader sets of nozzles for carrying out checking based on the principle of the method described above.

Thus, it appears obvious that by performing the alternate cycle described above, the number of detections can be reduced, in that it is not required to perform a detection for each nozzle.

Prior to performing any one of the control cycles previously described, a preliminary check may be performed with all the nozzles (6) being brought into the open conditions thereof and with the pressure differential between the inlet and outlet sections being detected. The detected differential is compared with the second reference differential (D2). If the detected differential is less than a certain value compared to the second reference differential (D2), then it means that at least a certain number of nozzles is obstructed. This provides the control processor with an information about the number of nozzles that are to be identified as malfunctioning.

The present invention offers important advantages.

The control method described above can be performed in an extremely quickly manner prior to starting each production cycle, or at any time one wishes. Thus, there is no need to make test prints and then evaluate quality thereof.

The feeding circuit may be perfectly integrated within the current printheads, thereby allowing execution of the control method without any installation work or particularly relevant configurations being required.

The invention claimed is:

1. A control method for detecting the operating status of the nozzles of an ink-jet printhead, comprising the following steps:

detecting an inlet pressure and an outlet pressure within a feeding channel (5) of the nozzles (6) in a closing condition of all nozzles (6);

detecting a first reference pressure differential (D1) between the inlet pressure and the outlet pressure;

opening each nozzle (6) in sequence, separately from the others;

detecting the pressure differential (Di) between the inlet pressure and the outlet pressure in an opening condition of each single nozzle (6);

comparing the pressure differential detected (Di) with the first reference pressure differential (D1).

2. A control method according to claim 1, comprising the following steps:

identifying the nozzle (6) as properly working if the pressure differential detected (Di) differs from the first reference pressure differential (D1) beyond a preset value;

identifying the nozzle (6) as not properly working if the pressure differential detected (Di) does not differ from the first reference pressure differential (D1) beyond said preset value.

3. A control method for detecting the operating status of the nozzles of an ink-jet printhead, comprising the following steps:

detecting a reference pressure differential (D2) in an initial switching on condition of the printhead and of all open nozzles (6);

on the basis of a position coefficient (Cpi) for each nozzle (6), an ideal pressure (Pw) of the printing fluid within the feeding channel (5) and the number of nozzles (6) arranged within the printhead, calculating an ideal loss of pressure (Api) for each printhead nozzle (6) as:

$$Api = \frac{Pw - D2}{\text{number of nozzles}} \times Cpi.$$

4. A control method according to claim 3, comprising the following steps:

opening each nozzle (6) in sequence, separately from the others;

detecting the pressure differential (Di) between the inlet pressure and the outlet pressure in an opening condition of each single nozzle (6);

comparing the pressure differential detected (Di) with the loss of ideal pressure (Api).

5. A control method according to claim 4, comprising the following step:

signaling a nozzle as a malfunctioning nozzle, if the differential detected (Di) for a nozzle (6), differs from a loss of ideal pressure (Api) beyond a certain threshold.

6. A control method according to claim 3, comprising a step of:

identifying a first set of nozzles pairs (6) adjacent one to another, which comprises all the present nozzles (6);

identifying a second set of nozzles pairs (6) adjacent one to another not comprising two nozzles (6) located at end positions;

for each pair of the adjacent nozzles (6), calculating a loss of ideal pressure as:

$$Apc_{i,i+1} = Ap_i + Ap_{i+1}.$$

7. A control method according to claim 6, comprising the following steps:

opening each pair of adjacent nozzles (6) in sequence that belong to the first set of nozzles, separately from the other nozzles;

detecting the pressure differential (Di,i+1) between the inlet pressure and the outlet pressure in the opening condition of each pair of nozzles (6);

for each pair of adjacent nozzles (6), comparing the pressure differential detected (Di,i+1) with the loss of ideal pressure ($Apc_{i,i+1}$) in respect to that adjacent pair of nozzles.

8. A control method according to claim 7, comprising the following steps:

signaling both nozzles as malfunctioning nozzles if the pressure differential detected (Di,i+1) in respect of a pair of adjacent nozzles is substantially equal to zero;

signaling both nozzles as functioning correctly if the pressure differential detected (Di, i+1) for a pair of adjacent nozzles is substantially equal to the loss of ideal pressure ($Apc_{i,i+1}$) for that pair of adjacent nozzles;

signaling the pair of adjacent nozzles as operating under uncertain conditions, if the pressure differential detected (Di, i+1) in respect to a pair of adjacent nozzles, substantially differs from the loss of ideal pressure ($Apc_{i,i+1}$) in respect to said pair of adjacent nozzles.

9. A control method according to claim 8, comprising the following step:

opening the pairs of nozzles (6) adjacent to the second set of nozzles, separately from the other nozzles, in respect to which pairs of nozzles (6), one nozzle was signaled as operating under uncertain conditions;

detecting the pressure differential (Di, i+1) between the inlet pressure and the outlet pressure in the opening condition of each pair of open nozzles (6);

for each pair of adjacent nozzles (6), comparing the pressure differential detected (Di,i+1) with the loss of ideal pressure ($Apc_{i,i+1}$) in respect to that adjacent pair of nozzles.

10. A printhead for an ink-jet printer, comprising a feeding circuit, the feeding circuit comprising: a feeding channel (5), arranged to feed a printing fluid to a plurality of nozzles (6), which feeding channel (5) is provided with an inlet section (1) and an outlet section (2); characterized in that the feeding circuit comprises: a first pressure sensor (3), that is so arranged as to detect pressure in the inlet section (1) of the channel (5), or in an area next to the inlet section (1); a second pressure sensor (4), that is so arranged as to detect the pressure in the outlet section (2) of the channel (5), or in an area next to the outlet section (2); wherein the nozzles (6) directly communicate with the feeding channel (5) and wherein each nozzle (6) is provided with a respective shutter (7), which is at least partially inserted within the feeding channel (5); the printhead further comprising a control processor arranged to control operating of each shutter (7) and to detect the pressure signals of the first and second pressure sensors (3, 4); wherein the control processor is configured to perform a control method for detecting the operating status of the nozzles of the printhead, the control method comprising the following steps:

detecting an inlet pressure and an outlet pressure within the feeding channel (5) of the nozzles (6) in a closing condition of all nozzles (6);

detecting a first reference pressure differential (D1) between the inlet pressure and the outlet pressure;

opening each nozzle (6) in sequence separately from the others;

detecting the pressure differential (Di) between the inlet pressure and the outlet pressure in an opening condition of each single nozzle (6);

comparing the pressure differential detected (Di) with the first reference pressure differential (D1).

* * * * *